US005311234A

United States Patent [19]

Heinzer

[11] Patent Number: 5,311,234

[45] Date of Patent: May 10, 1994

[54] DEVELOPING APPARATUS

[75] Inventor: Paul A. Heinzer, Pully, Switzerland

[73] Assignee: Multitec AG, Berne, Switzerland

[21] Appl. No.: 946,621

[22] Filed: Sep. 18, 1992

[30] Foreign Application Priority Data

Sep. 20, 1991 [CH] Switzerland ..... 2795/91-1

[51] Int. Cl.[5] ..... G03D 5/00

[52] U.S. Cl. ..... 354/317; 118/249

[58] Field of Search ..... 355/27-29, 355/100, 106, 256-258; 354/316-324; 118/227, 249, 262

[56] References Cited

U.S. PATENT DOCUMENTS

| | | | |
|---|---|---|---|
| 3,874,331 | 4/1975 | Kirsen | 118/227 |
| 4,068,620 | 1/1978 | Peters | 118/249 |
| 4,135,475 | 1/1979 | Bomers | 118/249 |
| 4,821,072 | 4/1989 | Nagumo | 354/304 X |

FOREIGN PATENT DOCUMENTS 641146 1/1937 Fed. Rep. of Germany .

*Primary Examiner*—D. Rutledge

*Attorney, Agent, or Firm*—Stevens, Davis, Miller & Mosher

[57] ABSTRACT

The apparatus comprises a metering roller (7) for the metered supply of liquid developer to an applicator roller (10). A profiled roller (11) is provided for pressing the photosensitive stock against the applicator roller. The profiled roller has a cylindrical core (12). The outer surface of the core is completely covered with a coating (13) of a permanently elastic material. The surface of the coating remote from the core is provided with projecting, mutually staggered, substantially conical or pyramidal nubs (14). The nubs are made of the same permanently elastic material as the coating. A pressing roller (17) rests against the profiled roller and, in the direction of travel designated from I to O of the stock to be developed, precedes the point of contact of the profiled roller against the applicator roller. Stock inserted at I is grasped at the point of contact (19) between the pressing roller and the profiled roller and conveyed on. Because of the soft nubs and the relatively light bearing pressure of the pressing roller, the stock to be developed can be shifted or straightened before it comes in contact with the liquid developer. Adjacent nubs have the tendency to spread apart in the region of the points of contact with either the pressing roller or the applicator roller. An additional tightening of the stock to be developed is thereby produced between these nubs. Especially at the applicator roller, this leads to extremely uniform application of the liquid.

19 Claims, 4 Drawing Sheets

DEVELOPING APPARATUS

BACKGROUND OF THE INVENTION

This invention relates to apparatus for developing one face of photosensitive sheet or strip stock, of the type having a metering roller for the metered supply of developer liquid to an applicator roller, a profiled roller for pressing the stock against the applicator roller, as well as guide means for feeding and guiding the stock.

The invention relates particularly to apparatus for moistening one side of sheets or of paper strips.

Prior art apparatus of this kind is utilized in copying equipment, for example, in which it is intended for developing diazotypes.

Apparatus of this type is diagrammatically depicted and described in U.S. Pat. No. 4,068,620. It contains a metering roller made of a metal core surrounded by a plastic sheath. The sheath is provided with fine, helical grooves. The metering roller transfers liquid developer to an applicator roller consisting of a metal core and a smooth rubber sheath. Pressing against the applicator roller is a profiled roller comprising a metal core and a sheath of profiled rings ranged side by side. Each of the profiled rings has outwardly projecting profiles on its outside surface, preferably pyramid-shaped points, regularly distributed over the circumference and repeated n times. Each two adjoining rings are twisted by a certain angle relative to one another.

By means of the profiled roller utilized in this apparatus, it is intended to press the diazo paper uniformly against the applicator roller, the surface of the profiled roller having to remain as dry as possible in the absence of copy stock so that moistening of the back of a copy to be developed can be prevented.

It is proposed to make the profile rings of plastic or metal. The pyramid-shaped points are relatively hard and non-elastic.

In U.S. Pat. No. 4,135,475, reference is made to difficulties which arise with the aforementioned profiled roller. With very wide copiers which are customarily used for making diazotypes, because of sagging of the rollers, the forces acting upon the copy to be developed are not uniform over the entire length of the nip between the applicator roller and the profiled roller. Even small differences in the amount of liquid developer applied to the diazo layer cause fairly great differences in color intensity in the developed copy. Well developed locations alternate with locations developed weakly or not at all. In order to eliminate this problem, it is proposed to divide the profiled roller into a number of partial rollers joined to one another by connection elements in such a way that adjacent partial rollers are displaceable radially to one another. Associated with each partial roller is a spring element intended to press the partial roller against the applicator roller.

A drawback of this second prior art apparatus is the relatively complicated and expensive design, as well as the fact that between the individual partial rollers, where the spring elements engage, there are gaps in which the copy stock is not pressed against the applicator roller. The formation of streaks on the developed copy is possible.

SUMMARY OF THE INVENTION

It is an object of this invention to provide apparatus for developing one face of photosensitive sheet or strip stock which is of substantially simplified design as compared with the prior art.

Another object of the invention is to provide such developing apparatus which yields improved uniformity of the pressure of the photosensitive sheet or strip to be developed, hereafter to be collectively referred to as web, against the applicator roller, hence improved uniformity of the coloring of the finally developed copy.

To this end, in the apparatus according to the present invention, of the type initially mentioned, the profiled roller comprises a cylindrical core extending over the entire width of the apparatus, the outside surface of the core is completely covered with a coating of a permanently elastic material, and the surface of the coating remote from the core is provided with radially protruding and mutually staggered, substantially conical or pyramidal, deformable nubs of the same permanently elastic material.

It has unexpectedly been found that by means of the permanently elastic nubs, additional tightening of the web occurs during pressure against the applicator roller. Circumferentially adjacent nubs of the profiled roller have the tendency to spread apart, the section of the web situated between these nubs thus becoming tauter.

By means of the permanently elastic, relatively soft nubs, uniform pressure against the applicator roller of the web is achieved even in the case of very wide diazotype machines. Unavoidable slight sagging of the individual rollers no longer has an unfavorable effect. It is therefore unnecessary to construct the profiled roller of individual partial rollers.

The design is particularly advantageous when the coating of permanently elastic material is formed on sheaths ranged side by side and slipped onto the core, and when water-repellent silicone rubber is chosen as the material. Through the effect of the latter, the prevention of moistening of the side of the web remote from the applicator roller is additionally enhanced.

Another unexpected effect observed is that at the point of contact between the profiled roller and the applicator roller, the web can be displaced relatively easily. However, displacement at this location results in uneven application of the liquid developer in a certain area of the web and consequently in irregularity of the color intensity of the diazo layer of the copy. The unexpectedly found possibility of easy displacement of the web has been made use of in a further development for aligning the web as follows: in the direction of travel of the web, a pressing part is disposed before the aforementioned point of contact between the profiled roller and the applicator roller, this pressing part and the profiled roller together forming a further point of contact. The latter is intended particularly for drawing in and transporting the copy stock to be developed when it is fed to the apparatus. It is easily possible to align this web in a straight path. If this is done before the web reaches the point of contact between the profiled roller and the applicator roller, the quality of the copy is not impaired. Especially in the case of an elongated web, such as continuous stock, this possibility of alignment is a substantial advantage.

BRIEF DESCRIPTION OF PREFERRED EMBODIMENTS

Preferred embodiments of the invention will now be described in detail with reference to the accompanying drawings, in which:

FIG. 1 is a partial cross-section through a diazotype machine equipped with a first embodiment of the inventive developing apparatus, FIG. 2 is a partial front elevation of the various rollers of the apparatus of FIG. 1, the profiled roller being shown partially in section, FIG. 3 is an enlarged detail of the applicator roller and the profiled roller, showing particularly the pressing relationship of the two rollers to one another during passage of a web to be developed, and FIG. 4 is a partial cross-section through a diazotype machine equipped with a second embodiment of the inventive apparatus.

DETAILED DESCRIPTION OF PREFERRED EMBODIMENTS

Figure 1:
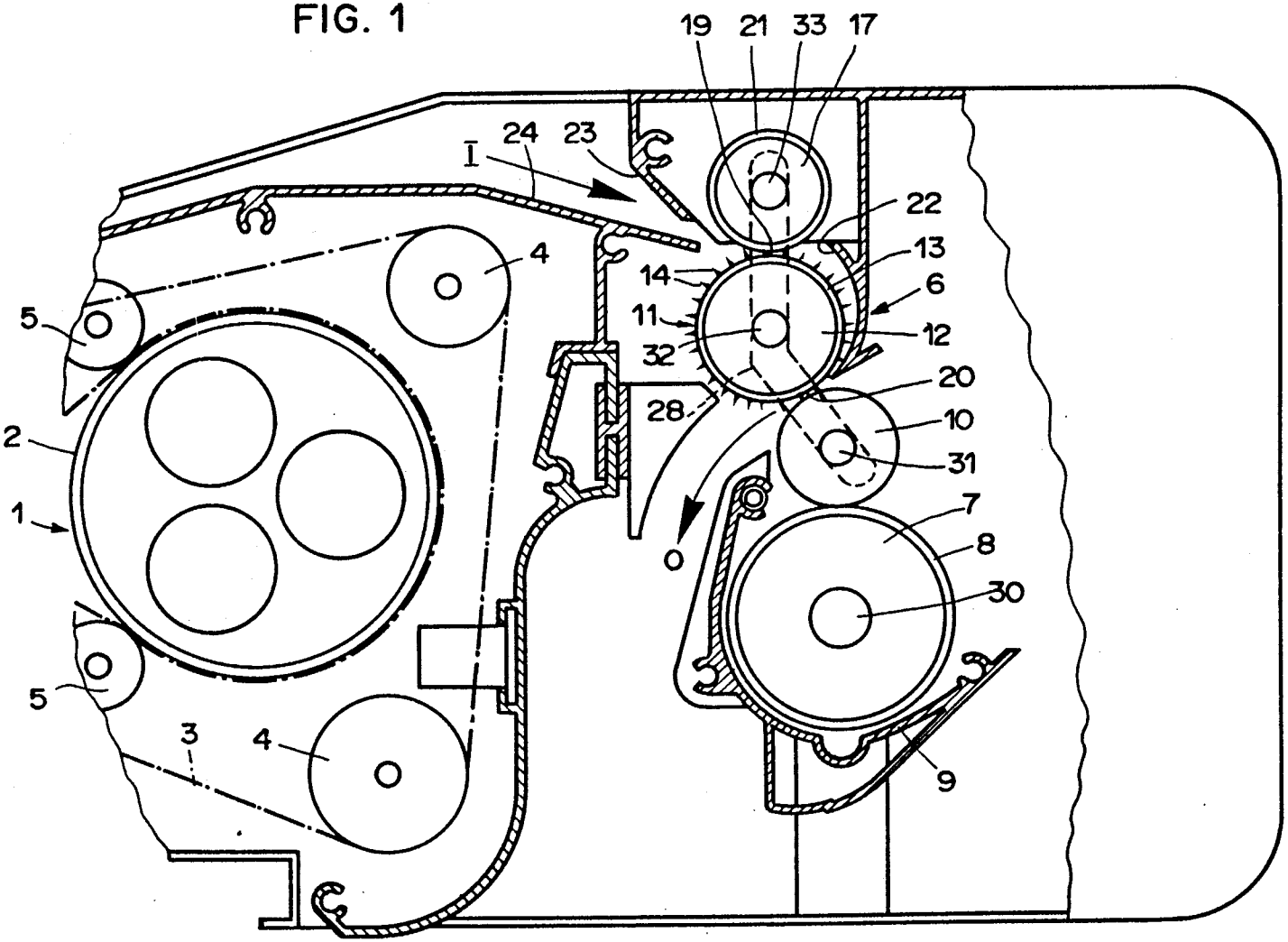
Figure 2:
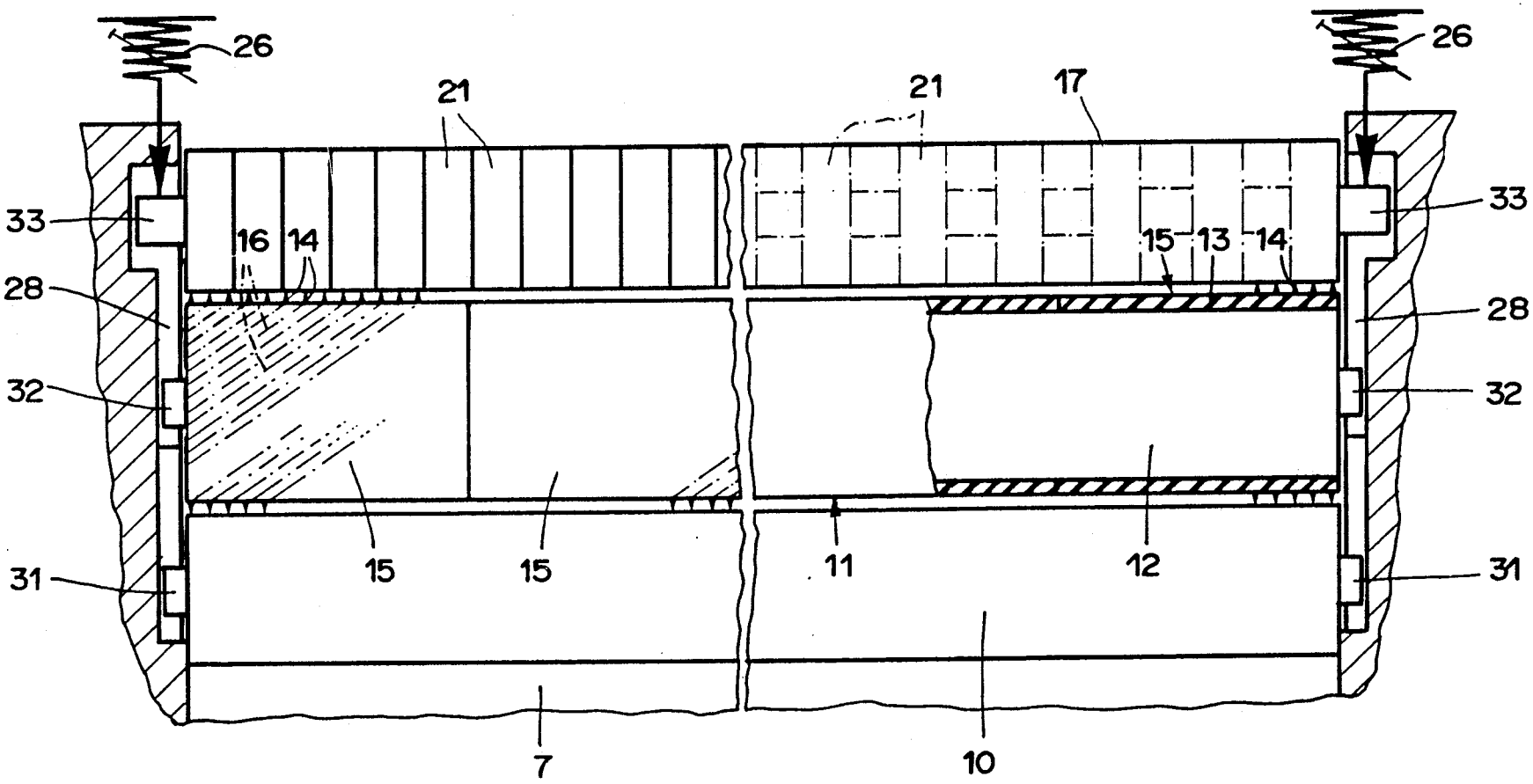

The diazotype machine partially illustrated in FIGS. 1 and 2 essentially comprises an exposure unit 1 having an exposure drum 2, usually consisting of a transparent glass tube in which luminescent bodies are disposed. Revolving conveyor belts 3, which are rereouted several times over guide rollers 4, ensure that an original of a drawing, together with a web provided on one side with a photosensitive layer, e.g., a diazo layer, is led around exposure drum 2. During this operation, the diazo layer is exposed. Pressing rollers 5 ensure faultless entry and delivery of the copy stock fed to exposure unit 1. The exposed web must now be provided with a coat of liquid developer on the diazo layer side for making the unexposed areas of the layer visible. This is done in a developing apparatus 6 following exposure unit 1. Developing apparatus 6 consists of a rotatingly driven metering roller 7 which customarily has a metal core covered by a plastic sheath 8 provided on its outer surface with an extremely fine helical groove. Liquid developer may be supplied to metering roller 7 by means of a spray system, for example (not shown). Liquid developer sprayed on in excess drips into a collection channel 9 from which a return line (not shown) leads to a reservoir containing the liquid developer. Metering roller 7 transfers the liquid developer to an applicator roller 10 having a smooth outside surface. As in the prior art, applicator roller 10 may likewise comprise a metal core on which a rubber sheath having a smooth outside surface is disposed. Resting against applicator roller 10 is a profiled roller 11 in the form of a cylindrical core 12, preferably of a metallic substance, the outside surface of which is completely covered with a coating 13 of a permanently elastic material. The surface of coating 13 remote from core 12 is provided with radially projecting, mutually staggered, substantially conical or pyramidal nubs 14. These nubs are made of the same permanently elastic material as the coating 13. Nubs 14 are about 1–1.5 mm high, and there are preferably from 5 to 15 nubs per sq.cm. The ratio of nub height to the diameter of the base is about 1 to 3. Nubs 14 are preferably mutually staggered in such a way that, viewed in the axial direction of profiled roller 11, these nubs are not seen to be in rows. Advantageously, the staggering of nubs 14 is such that there are spiralling nub rows 16 on the outer surface of coating 13. Materials such as elastomers, gum resins, or rubber are suitable for making the permanently elastic coating. A particularly advantageous effect is achieved with silicone rubber. This material is water-repellent. Since every effort must be made to keep the side of the web remote from the applicator roller from becoming wet, care must be taken that the profiled roller does not take up any liquid developer, if possible, when there is no web to be developed between the applicator roller 10 and the profiled roller 11. This is achieved by the presence of nubs 14, on the one hand, and is additionally assisted by the use of silicone rubber, on the other hand.

Coating 13 and nubs 14 are relatively soft. The hardness of the permanently elastic material used should be in the range of from 20 to 70 Shore A, preferably between 30 and 40 Shore A.

Profiled roller 11 can be constructed especially simply and inexpensively when sheaths 15, which have been made of the permanently elastic material in an injection molding process, for instance, are slipped on the cylindrical core 12 side by side.

The bearing pressure of profiled roller 11 on applicator roller 10 is light. It has unexpectedly been found that as a result of this light contact pressure and of the elastic nubs 14, a web situated between profiled roller 11 and applicator roller 10 can easily be shifted, i.e., aligned. Although such displacement is not advisable at the location just mentioned because irregularities in the color intensity of the diazo layer of the developed copy are produced thereby, this finding has been utilized to dispose in developing apparatus 6 a pressing part—in this case a pressing roller 17—in such a way that it forms together with profiled roller 11 a first contact point 19 which, in the direction of travel of the web through the developing apparatus 6, precedes a second contact point 20 of the applicator roller 10 with the profiled roller 11. The direction of travel of the web is indicated by arrows I→O. Guide means 22, 23, and 24 are intended to feed the copy to be developed to applicator roller 10. A baffle 22, bent substantially arcuately and extending over approximately the entire length of profiled roller 11, is intended to deflect the web leaving the first contact point 19 and lead it to the second contact point 20 between the profiled roller 11 and the applicator roller 10. By means of pressing roller 17, automatic feeding and conveyance of the web is achieved even before it comes in contact with the applicator roller. It is thereby possible to displace or straighten the web inserted between an upper guide plate 23 and a lower guide plate 24 before the web comes in contact with the moist surface of applicator roller 10. This possibility is a great advantage especially in the case of large sheets or a continuous web.

Metering roller 7 is mounted on lateral flanges of a machine frame by means of first journals 30. In the embodiment illustrated, there are groove-shaped guide tracks 28 on the right and left of the machine frame, in which tracks applicator roller 10 is held for displacement along track 28 by means of second journals 31, profiled roller 11 by means of third journals 32, and pressing roller 17 by means of fourth journals 33. The bearing pressure of each upper roller on the associated lower roller is determined substantially by the weight of the respective roller itself and the weight of the rollers above it. Provision is made for adjustment of the bearing pressure of pressing roller 17 against profiled roller 11 by means of pressure-adjustment means 26, depicted merely symbolically in FIG. 2 as variable-tension compression springs. Owing to the way in which the different rollers are mounted, as described above, not only can the bearing pressure between pressing roller 17 and profiled roller 11 be varied by means of pressure-adjustment means 26, but the corresponding bearing pressures between applicator roller 10 and metering roller 7, and between profiled roller 11 and applicator roller 10, can also be varied. The design described makes it simple to dismount and remount the individual rollers, e.g., for cleaning purposes.

Pressing roller 17 preferably also has a metal core onto which disks 21, e.g., of rubber, having a smooth outer surface, are slid in a manner known per se. Disks 21 may either be ranged side by side, as shown on the left-hand side of FIG. 2, or may be spaced from one another instead. This is indicated in dot-dash lines on the right-hand side of FIG. 2.

Figure 3:
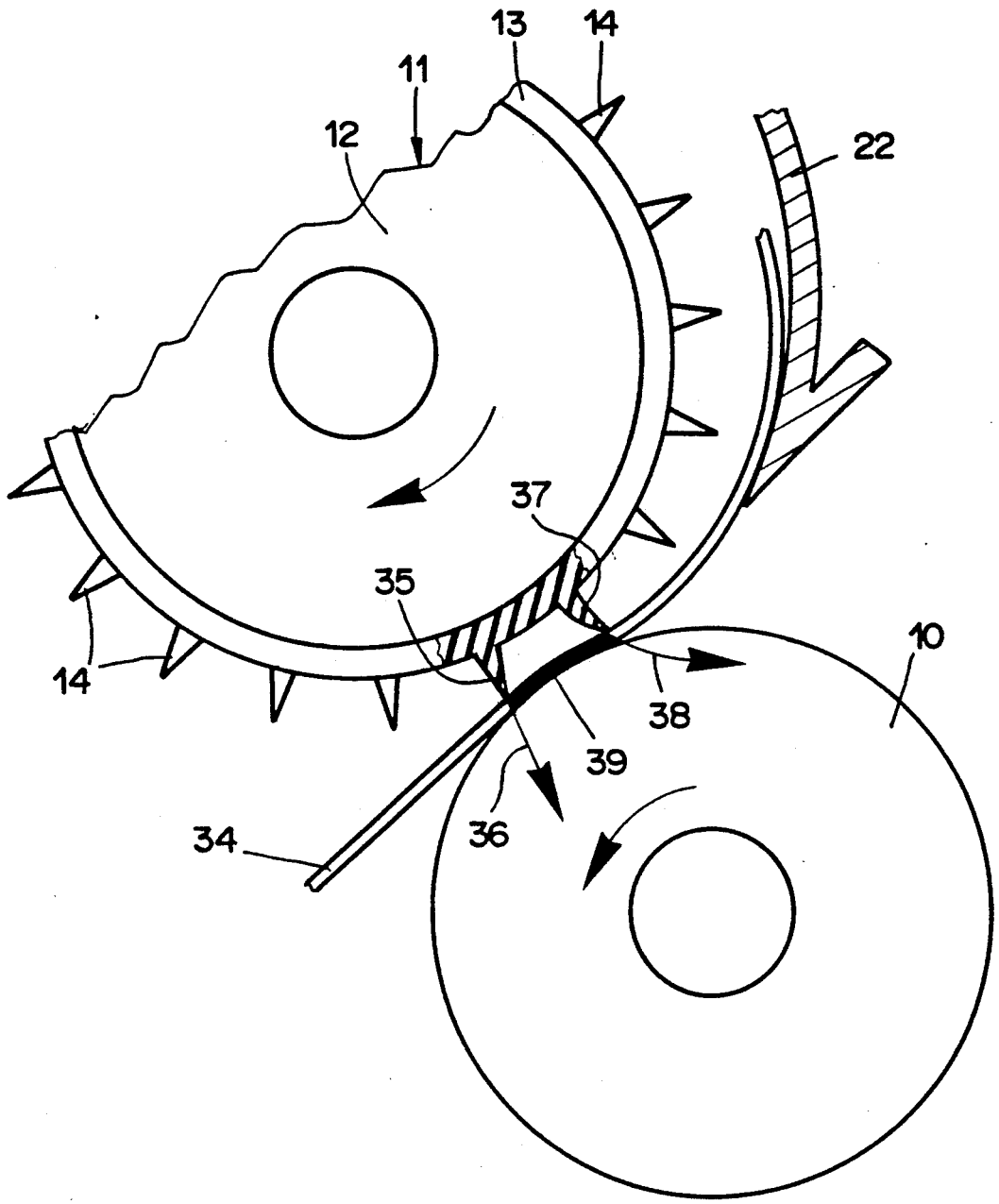

In FIG. 3, the second point of contact of profiled roller 11 with applicator roller 10 is shown enlarged. A web 34 to be developed is situated between these two rollers.

The soft, conical or pyramidal nubs 14 protrude radially from profiled roller 11 on the side of the soft coating 13 remote from core 12. The tips of circumferentially adjacent nubs 14 which come in contact with web 34 in the region of applicator roller 10 are spread apart as the web passes through, as indicated in FIG. 3 by the nubs designated 35 and, in particular, 37. The directions in which these nubs are bent aside are made clear by arrows 36 and 38, respectively. This deflection or spreading apart has the effect of making web 34 tauter in the region designated by reference numeral 39. This ensures that web 34 rests against applicator roller 10 especially evenly. The result is increased uniformity of application of the liquid developer to the stock to be developed.

Figure 4:
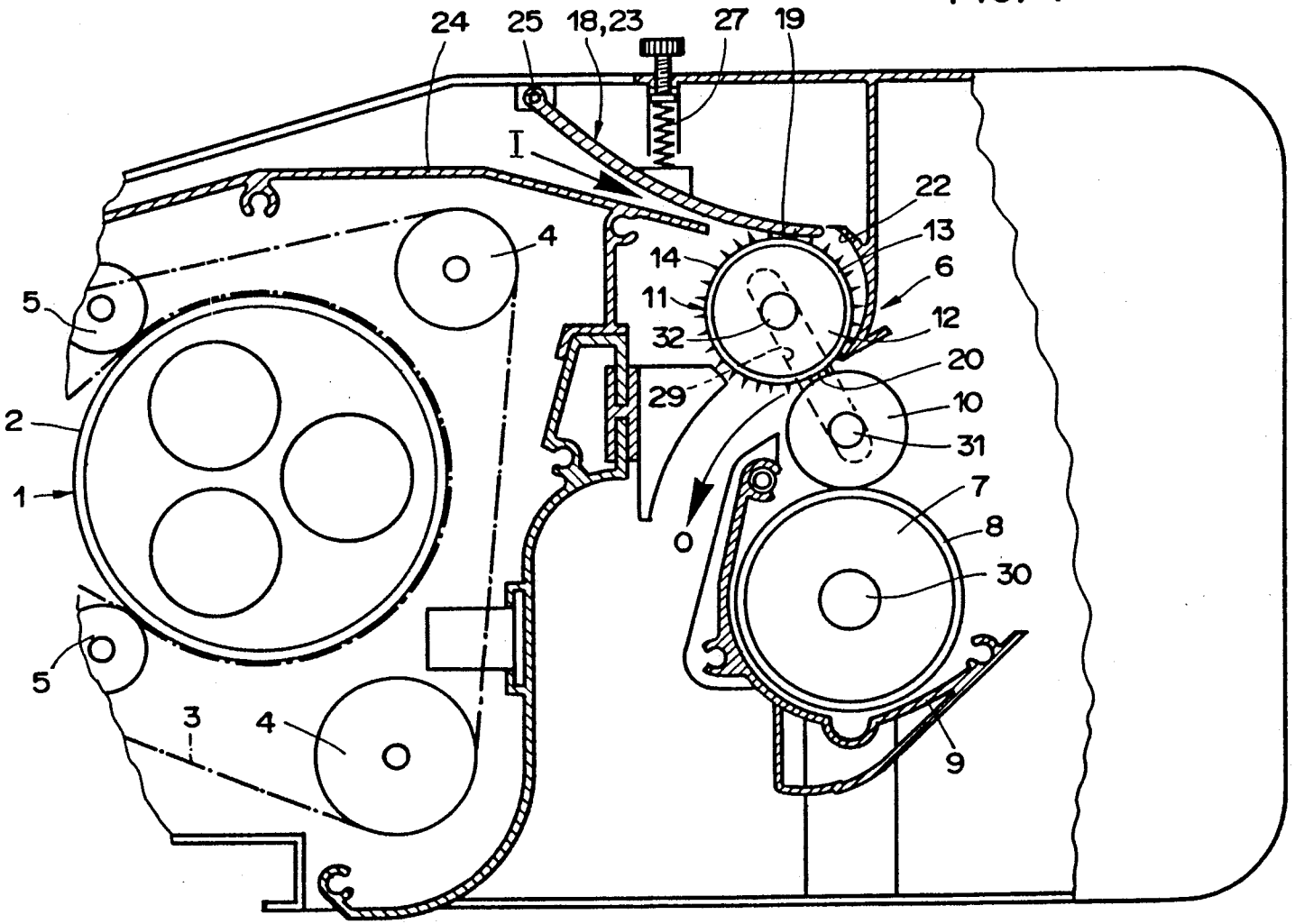

Another embodiment of a developing apparatus 6 according to the present invention is illustrated in FIG. 4. It differs from the embodiment described above only in that the pressing roller is replaced by a tongue-shaped, bent pressing plate 18 pivoted about a swivel axis 25. By means of pressure-adjustment means 27, the bearing pressure of pressing plate 18 against profiled roller 11 can be adjusted. Both profiled roller 11 and applicator roller 10 are displaceably mounted in lateral guide tracks 29 in a similar manner as in the previous embodiment. Hence, by means of pressure-adjustment means 27, the bearing pressure of pressing plate 18 against profiled roller 11, the bearing pressure of the latter against applicator roller 10, and the bearing pressure of applicator roller 10 against metering roller 7 can be adjusted, as already described previously. Pressing plate 18, which may be made of a plurality of partial plates disposed next to one another, further performs the function of upper guide plate 23 in the previous embodiment.

The two embodiments of the inventive developing apparatus described above are of extremely simple construction. Owing to the uniform pressure of the stock to be developed against the applicator roller, the quality of the diazotypes made with such apparatus is excellent. The sheaths of the profiled roller made of silicone, with their soft nubs, are water-repellent. Wetting of the back of the web is thereby additionally lessened. By means of the soft nubs and the relatively weak pressure of the pressing part on the profiled roller, sheets fed in may conveniently be shifted and straightened before they come in contact with liquid developer. In the region of the contact point of the profiled roller with the applicator roller, the spreading apart of adjacent nubs brings about an additional tightening of the web in the vicinity of these nubs. These are the most important advantages achieved by means of the developing apparatus according to the present invention.

What is claimed is:

1. In an apparatus for developing one face of photosensitive sheet or strip stock, of the type having an applicator roller, a metering roller for metered supply of developer liquid to said applicator roller, a profiled roller for pressing the stock against said applicator roller, and guide means for feeding and guiding the stock, the improvement comprising:

a cylindrical core forming part of said profiled roller and extending over an entire width of said apparatus, a coating of permanently elastic material completely covering said core, and a plurality of mutually staggered deformable nubs of said permanently elastic material protruding radially from the surface of said coating remote from said core, wherein said coating is formed by a plurality of sheaths of said permanently elastic material, ranged side by side and slipped onto said core.

2. The apparatus of claim 1, wherein said permanently elastic material is an elastomer.

3. The apparatus of claim 1, wherein said permanently elastic material is a gum resin.

4. The apparatus of claim 1, wherein said permanently elastic material is rubber.

5. The apparatus of claim 1, wherein said permanently elastic material is silicone rubber.

6. The apparatus of claim 1, wherein the hardness of said permanently elastic material is from 20 to 70 Shore A.

7. The apparatus of claim 1, wherein said nubs are so mutually staggered that, viewed in the axial direction of said profiled roller, said nubs are not seen to be in rows.

8. The apparatus of claim 1, wherein said nubs are substantially conical.

9. The apparatus of claim 1, wherein said nubs are substantially pyramidal.

10. In an apparatus for developing one face of photosensitive sheet or strip stock, of the type having an applicator roller, a metering roller for metered supply of developer liquid to said applicator roller, a profiled roller for pressing the stock against said applicator roller, and guide means for feeding and guiding the stock, the improvement comprising:

a cylindrical core forming part of said profiled roller and extending over an entire width of said apparatus, a coating of permanently elastic material completely covering said core, and a plurality of mutually staggered deformable nubs of said permanently elastic material protruding radially from the surface of said coating remote from said core, further comprising at least one pressing means associated with said profiled roller for pressing against said nubs substantially in a radial direction to the roller, a first point of contact of said profiled roller with said pressing means preceding a second point of contact of said profiled roller with said applicator roller, and the stock to be developed first flowing through the first point of contact between the profiled roller and the pressing means and then through the second point of contact between the profiled roller and the applicator roller.

11. The apparatus of claim 10, wherein said guide means comprise a deflecting element disposed adjacent said first and second points of contact for deflecting and feeding the stock leaving said first point of contact to said second point of contact.

12. The apparatus of claim 10, wherein said pressing means is a pressing roller.

13. The apparatus of claim 10, wherein said pressing means is at least one pivotingly disposed, tongue-shaped, bent pressing plate.

14. The apparatus of claim 10, further comprising means for adjusting the pressure of said pressing means against said profiled roller.

15. The apparatus of claim 14, further comprising tracks wherein said profiled roller is guided at both ends thereof, said profiled roller being displaceable substantially radially to said applicator roller.

16. The apparatus of claim 15, wherein said pressing means is a pressing roller also guided in said tracks.

17. In an apparatus for developing one face of photosensitive sheet or strip stock, of the type having an applicator roller, a metering roller for metered supply of developer liquid to said applicator roller, a profiled roller for pressing the stock against said applicator roller, and guide means for feeding and guiding the stock, the improvement comprising:

a cylindrical core forming part of said profiled roller and extending over an entire width of said apparatus, a coating of permanently elastic material completely covering said core, and a plurality of mutually staggered deformable nubs of said permanently elastic material protruding radially from the surface of said coating remote from said core, wherein said coating is formed by a plurality of sheaths of said permanently elastic material, ranged side by side and slipped onto said core, further comprising at least one pressing means associated with said profiled roller for pressing against said nubs substantially in a radial direction of the roller, a first point of contact of said profiled roller with said pressing means preceding a second point of contact of said profiled roller with said applicator roller relative to the direction of travel of the stock.

18. In a apparatus for developing one face of photosensitive sheet or strip stock, of the type having an applicator roller, a metering roller for metered supply of developer liquid to said applicator roller, a profiled roller for pressing the stock against said applicator roller, and guide means for feeding and guiding the stock, the improvement comprising:

a cylindrical core forming part of said profiled roller and extending over an entire width of said apparatus, a coating of permanently elastic material completely covering said core, and a plurality of mutually staggered deformable conical nubs of said permanently elastic material protruding radially from the surface of said coating remote from said core, the height of the nubs being 1–1.5 millimeters and the ratio of hub height to the diameter of the base is 1 to 3.

19. Method for developing one face of photo sensitive sheet or strip stock with an apparatus having an applicator roller, a metering roller for metered supply of developer liquid to said applicator roller, a profiled roller for pressing the stock against said applicator roller, and guide means for feeding and guiding the stock between the profiled roller and the applicator roller, said method comprising providing the surface of coating of the profiled roller with fine radially projecting, mutually staggered, permanently elastic nubs, deflecting and circumferentially spreading apart adjacent nubs which come in contact with the stock in the region of the applicator roller as the stock passes through, thus creating an additional tightening of the stock in the region where the nubs are bent aside.

* * * * *